United States Patent [19]

Fast

[11] Patent Number: 4,693,024

[45] Date of Patent: Sep. 15, 1987

[54] PRODUCT INFORMATION TAGS WITH IMPROVED MOUNTING ARRANGEMENTS

[76] Inventor: Jacob Fast, 7651 NW. 9th St., Plantation, Fla. 33317

[21] Appl. No.: 809,789

[22] Filed: Dec. 17, 1985

Related U.S. Application Data

[63] Continuation-in-part of Ser. No. 562,067, Dec. 16, 1983, which is a continuation-in-part of Ser. No. 519,226, Aug. 2, 1983, Pat. No. 4,525,944, which is a continuation-in-part of Ser. No. 473,650, Mar. 9, 1983, Pat. No. 4,531,313.

[51] Int. Cl.[4] ..... G09F 3/08

[52] U.S. Cl. ..... 40/20 R; 40/584; 40/19.5; 40/124.1

[58] Field of Search ..... 40/2, 20, 19.5, 124.1, 40/584, 10 R

[56] References Cited

U.S. PATENT DOCUMENTS

| | | | |
|---|---|---|---|
| 2,199,968 | 5/1940 | Flood | 40/25 R |
| 3,706,150 | 12/1972 | Greenberger | 40/124.1 |
| 3,977,109 | 8/1976 | Berry et al. | 40/124.1 |
| 4,351,440 | 9/1982 | Thalenfeld | 40/19.5 |
| 4,463,510 | 8/1984 | Windish | 40/19.5 |
| 4,463,515 | 8/1984 | Windish | 40/19.5 |
| 4,525,944 | 7/1985 | Fast | 40/584 |
| 4,583,308 | 4/1986 | Taub | 40/19.5 |
| 4,646,454 | 3/1987 | Fast | 40/124.1 |

*Primary Examiner*—Gene Mancene
*Assistant Examiner*—Wenceslao J. Contreras
*Attorney, Agent, or Firm*—Holman & Stern

[57] ABSTRACT

Product information tags formed from plastic sheet are adapted to engage a merchandise support hook between two arms of an angle iron hook support member. In one form of the invention a mounting portion of the sheet is divided into two panels with a transverse fold line therebetween and apertures in the respective panels connected by a longitudinal slit which allows the mounting portion to be pressed down over a part of the hook within the angle-iron support and snapped into place with the respective panels juxtaposed with the limbs of the support. In a second form of the invention the mounting portion of the tag is formed of four panels which fold to provide a triangular-section wedge with similar apertures and longitudinal slit allowing the wedge to be snapped over the hook into the angle iron support.

21 Claims, 11 Drawing Figures

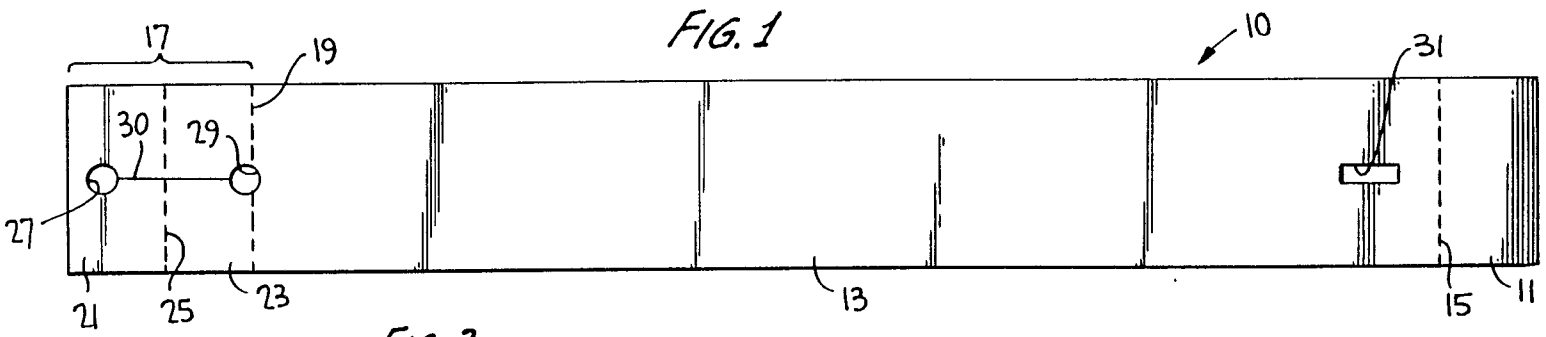
FIG. 1
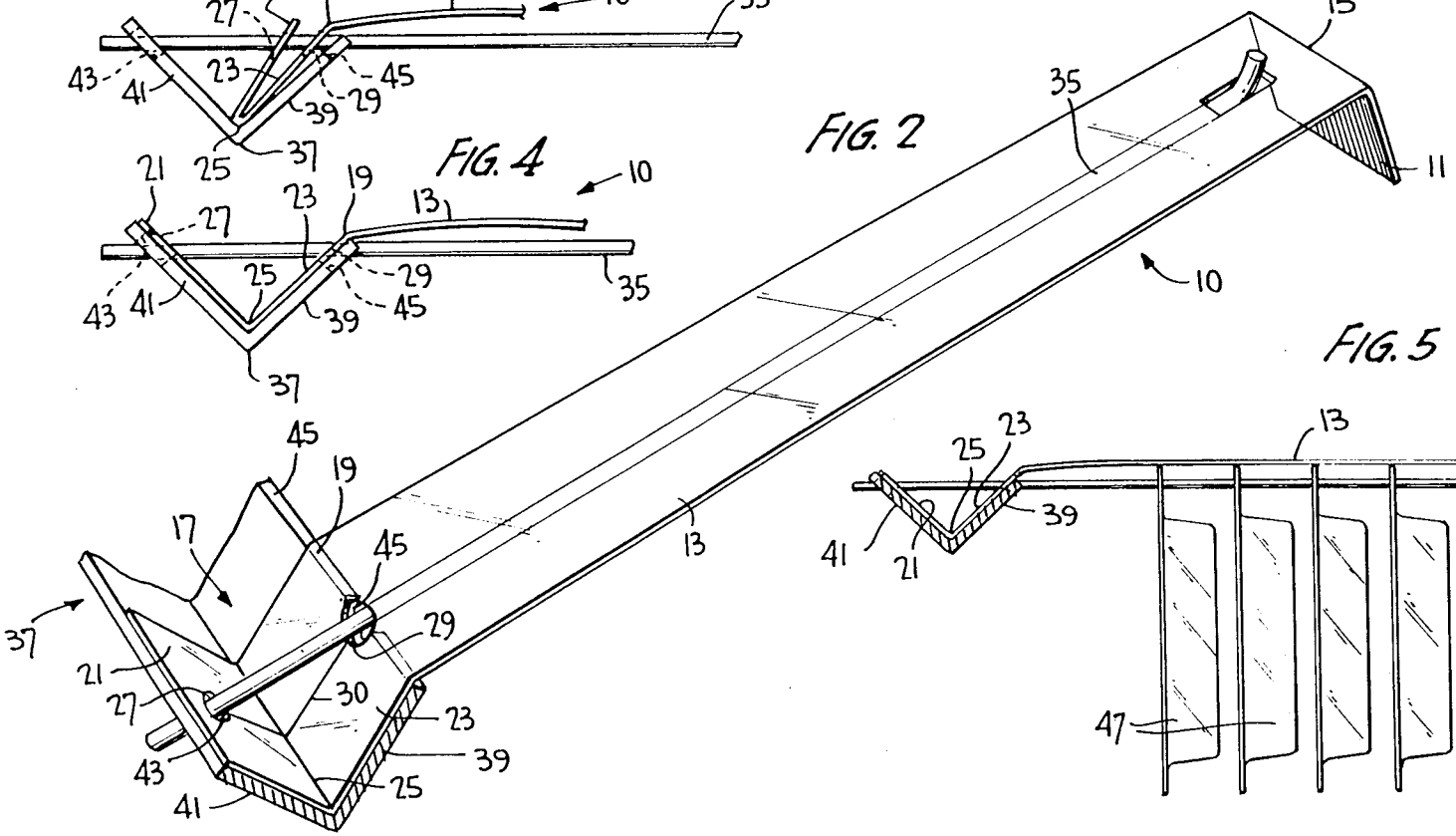
FIG. 2
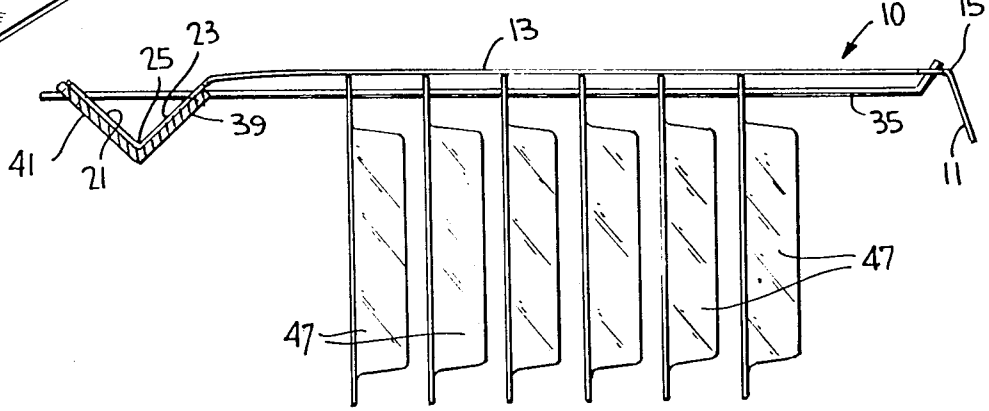
FIG. 5
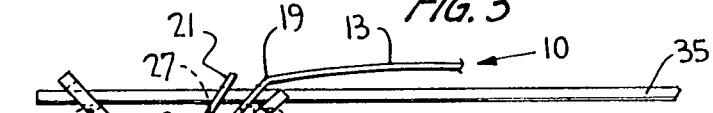
FIG. 3
FIG. 4

PRODUCT INFORMATION TAGS WITH IMPROVED MOUNTING ARRANGEMENTS

CROSS REFERENCE TO RELATED APPLICATIONS

This patent application is a continuation-in-part of my co-pending U.S. patent application Ser. No. 562,067, filed Dec. 16, 1983 for "Product Information Tag With Improved Mounting Arrangement," itself a continuation-in-part of U.S. patent application Ser. No. 519,226, filed Aug. 2, 1983 and entitled "Improved Product Identification Tag", (now U.S. Pat. No. 4,525,944 issued July 2, 1985) which, in turn, is a continuation-in-part application of my co-pending U.S. patent application Ser. No. 473,650, filed Mar. 9, 1983 and entitled "Merchandise Information Tag With Improved Mounting Arrangement" (now U.S. Pat No. 4,531,313 issued July 30, 1985). The disclosures of those patent applications are expressly incorporated herein in their entirety by this reference.

BACKGROUND OF THE INVENTION

1. Technical Field

The present invention relates to product identification and information tags for merchandise suspended from horizontally-extended support hooks, and the like. More particularly, the present invention relates to such tags which are easily attached to and removed from the support hooks without being subject to inadvertent removal, and which display the product information forwardly of the supported merchandise.

2. Discussion of the Prior Art

In my aforesaid U.S. patents I disclose a merchandise information display tag formed from a plastic sheet which displays product information forwardly of items suspended from a horizontally-extending hook. The tag has a mounting portion by which it is secured to the proximal end of the hook, a distal or display portion which folds down over the distal end of the hook and an intermediate portion which extends horizontally between the mounting and display portions above the hook and the suspended merchandise items. The mounting portions of the tags disclosed in the aforesaid patent applications are configured to engage the proximal ends of various support hooks designed to be suspended on an apertured board. Such mounting portions are designed to be easily deployed on and removed from the support hooks but cannot be inadvertently removed or fall from the hook once the display tag has been deployed.

I have found that the display tags disclosed in my aforesaid patents are not optimally suited for mounting on certain types of support hooks which are suspended from structures other than apertured boards. For example, luncheon meat packages in supermarkets are generally suspended from hooks which have their proximal end mounted on an angle iron support. The angle iron support opens upwardly and has an aperture in its rearward leg and a slot at the forward edge of its forward leg. The proximal end of the support hook extends through and is secured in the aperture while a portion of the support hook rests in the slot. The mounting portions of my prior display tags are not properly configured to mount the display tag on the support hook at the angle iron support.

OBJECTS AND SUMMARY OF THE INVENTION

It is an object of the present invention to provide improved merchandise information display tags of the type described which can be readily attached to and removed from an angle iron-supported hook such that the tag cannot be inadvertently removed once it is deployed.

It is another object of the present invention to provide an improved product identification and information tag of the type described wherein the mounting portion is configured to permit the tag to be reliably poitioned on a support hook and an angle iron bracket from which the support hook is suspended.

A further object of the invention is to provide a product information and identification tag of the type described having a mounting portion designed to fit on a support hook and angle iron bracket as aforesaid in a manner affording particular lateral stability to the elongate intermediate portion of the tag which extends forwardly from the mounting portion over the support hook.

Still another object of the invention is to provide a product identification and information tag having a mounting portion specifically adapted to fit on a support hook and angle iron bracket as aforesaid even if the hook is located closely adjacent an attachment bracket at one or other end of the angle iron bracket.

In accordance with the present invention, the mounting portion of the product identification and information tag is configured for transverse folding into two sections or panels corresponding to the two legs of the angle iron support for the support hook. A rearward one of the panels of the mounting portion is provided with an aperture located substantially on the longitudinal center line of the tag which registers with the aperture in the rearward leg of the angle iron support when the mounting portion is properly deployed. A similar aperture is defined in a forward one of the panels of the mounting portion, this latter aperture being configured and located to register with the slot in the forward edge of the forward leg of the angle iron support. The plastic sheet from which the tag is fabricated includes a longitudinal substantially axially extending cut between the two apertures in the different panels of the mounting portion the cut extending across a transverse fold line defining a junction between the panels. The cut permits the mounting portion to be placed over a deployed support hook so that the two panels of the mounting portion can be pressed down over the hook and properly positioned against corresponding legs of the angle iron support.

In one embodiment of the invention, the mounting portion of the tag consists entirely of the two panels aforesaid which extend from a fold line defining the back end of the intermediate portion of the tag. In this form of the invention, the forward one of the apertures may overlap the fold line at the back end of the mounting portion.

In another embodiment of the invention, which provides improved lateral stability to the intermediate portion of the tag, the mounting portion may be formed from four panels which are folded transversely to form a substantially triangular-section depending wedge, the two apertured panels aforesaid forming the angled sides of the wedge and the other two panels being superposed at the top of the wedge and connected together with fold-out tabs to stabilize the wedge. Additionally, in this form of the invention, the tag may be provided with a press-out portion on one side to provide clearance for an attachment bracket at one end of the angle iron support when the tag is used on a hook closely adjacent such end. Moreover, in this arrangement, the tag can be folded either to present the press-out portion on the left or right of the tag to accomodate attachment brackets at either end of the angle iron support.

BRIEF DESCRIPTION OF THE DRAWINGS

These and other objects, features and many of the attendant advantages of the present invention will be better understood from the following detailed description when considered in connection with the accompanying drawings wherein like parts in each of the several figures are identified by the same reference numerals, and wherein:

FIG. 1 is a view in plan of a blank from which a first embodiment product identification and information tag of the present invention is formed by appropriate folding and punch-out of die-cut elements;

FIG. 2 is a view in perspective from above showing the first embodiment form of the product identification and information tag of the present invention deployed for use on a support hook which is supported from an angle iron support member;

FIG. 3 is a side view in elevation of a portion of the tag, support hook and angle iron support member of FIG. 2 wherein the manner of inserting the mounting portion of the tag is illustrated;

FIG. 4 is a view similar to FIG. 3 showing the tag fully deployed;

FIG. 5 is a side view in elevation of the fully deployed tag shown projecting over supported merchandise items which are suspended from the support hook;

DESCRIPTION OF PREFERRED EMBODIMENT

Figure 6:
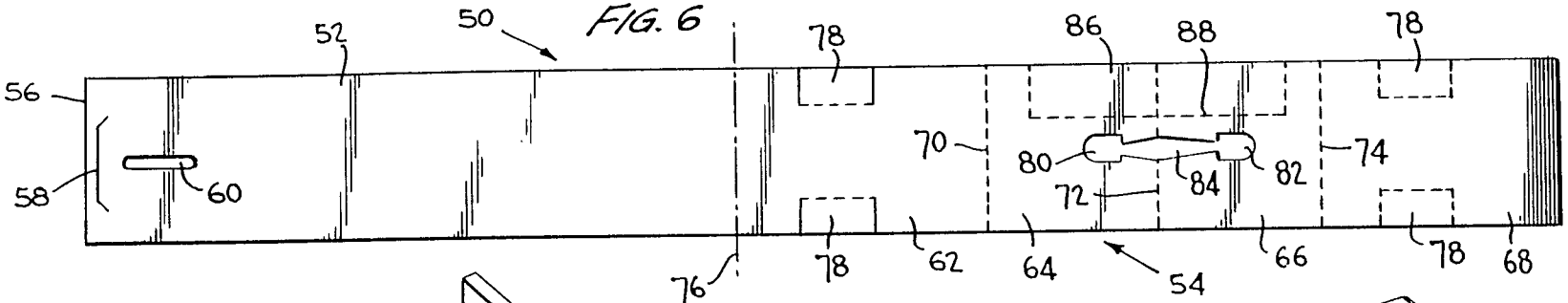
FIG. 6 is a view in plan of a blank from which a second embodiment product identification and information tag of the invention is formed.
Figure 8:
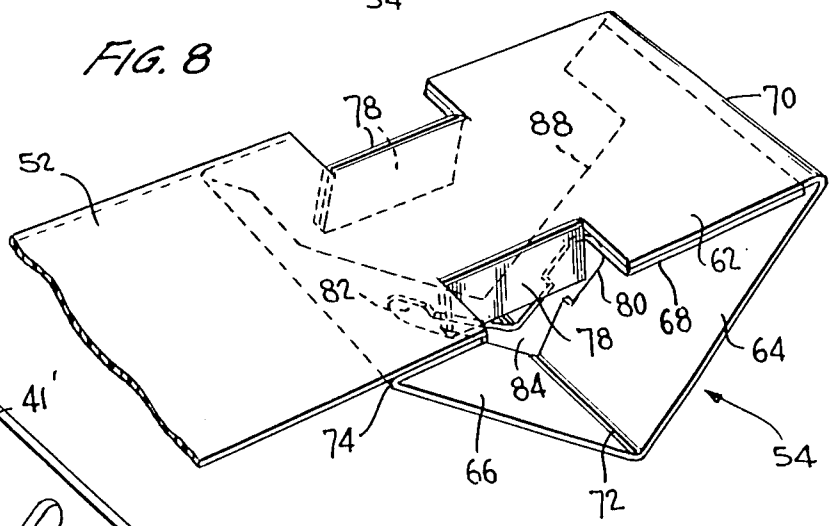
FIG. 8 is a perspective view of the rearward end of the tag showing the mounting portion formed by folding in one direction relative to the remainder of the tag.
Figure 10:
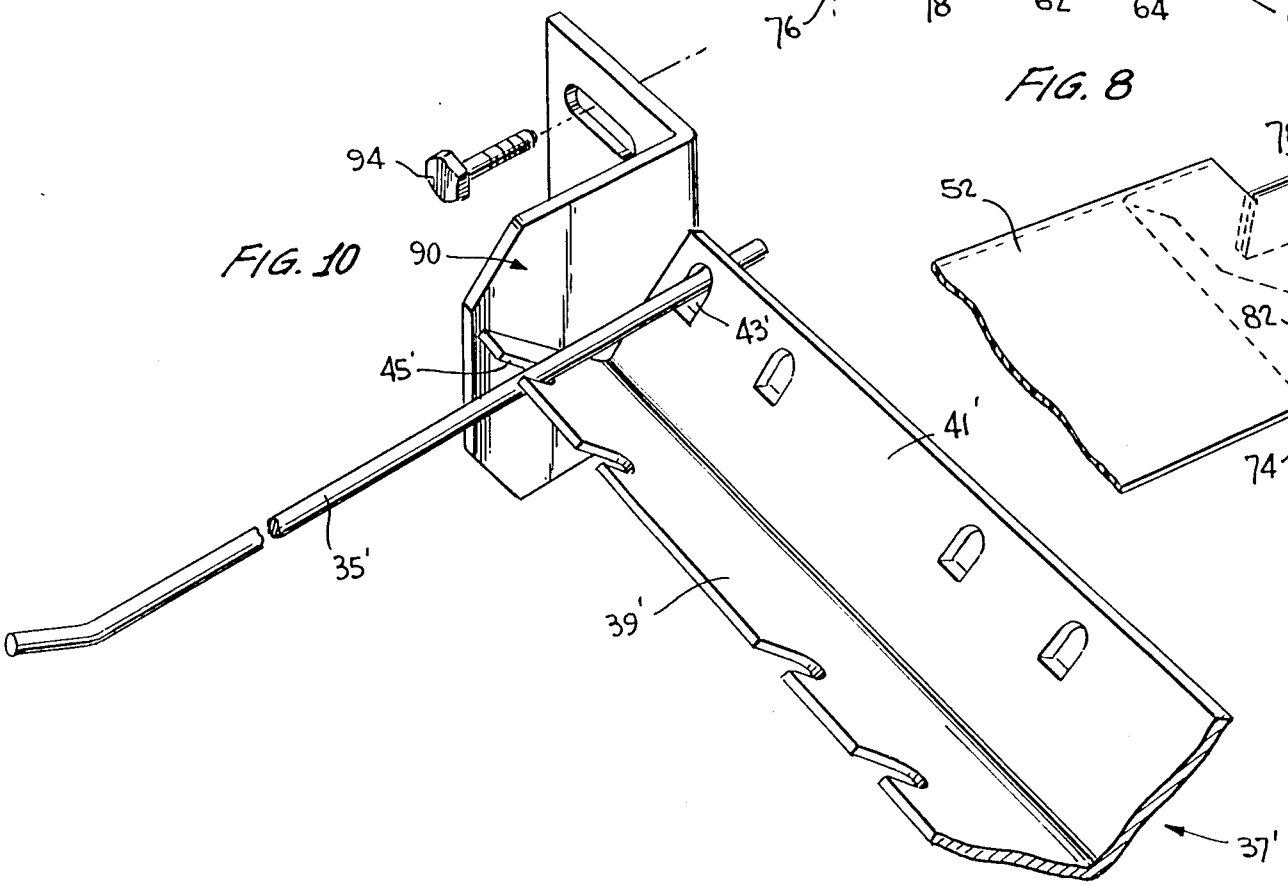
FIG. 10 is a perspective view of a support hook and angle iron support assembly on which the second embodiment tag can be mounted, this figure also showing an attachment bracket at one end of the support.

Referring to FIG. 1 in greater detail, a first embodiment product information and identification tag of the present invention takes the form of an elongated plastic sheet 10 in which suitable fold lines are impressed and appropriate apertures are die-cut. Specifically, sheet 10 is arranged in three distinct portions positioned at successive longitudinal locations along the sheet. At the distal end of the sheet 10 there is disposed a display portion 11 which is separated from an intermediate portion 13 by a fold line 15. The fold line 15 extends transversely across the entire width of the sheet 10. A mounting portion 17 is disposed at the proximal end of sheet 10 and is separated from the intermediate portion 13 by a second fold line 19. Fold line 19 also extends across the entire transverse dimension of sheet 10. The intermediate portion 13 is by far the longest of the three portions 11, 13 and 15. Mounting portion 17 is subdivided into two sections or panels 21 and 23 by means of a third fold line 25 which also extends transversely across the entire sheet width. Section 21 of mounting portion 17 includes the proximal end of the sheet 10 and is provided with a die-cut hole 27. A further die-cut hole 29 is provided in section 23 in a location such that it extends over fold line 19 to partially overlap intermediate portion 13. Holes 27 and 29 are longitudinally aligned along the longitudinal center line of sheet 10. A slit 30 extends along the longitudinal center line between holes 27 and 29.

Sheet 10 is provided with a longitudinally-extending slot 31 which is die-cut into the intermediate portion 13 at a longitudinal position proximate fold line 15. Slot 31 is centered along the longitudinal center line of sheet 10 so that it is in longitudinal alignment with holes or apertures 27 or 29. The position of slot 31 is selected so as to cause the slot to register with the distal end of a support hook in a manner described below.

Referring to FIGS. 2–5, the display tag of the present invention is arranged to be used in conjunction with a support hook 35 having its proximal end supported by an angle iron support member 37. Support member 37 comprises a sheet of metal or similar material which is folded or bent to define a first segment or arm 39 and a second segment or arm 41. Segments 39 and 41 are angularly spaced about the fold line and mounted in a manner such that the dihedral angle between them faces generally upward. Rearward segment 41 has an aperture defined therein, the aperture being of sufficient size to receive the proximal end of support hook 35. The forward edge 45 of forward segment 39 has a notch 45 defined therein. Notch 45 is positioned relative to aperture 43 so that the support hook 35 can be supported in notch 45 when the proximal end of the support hook extends through aperture 43. Support 35 may be secured in aperture 43 and slot 45, or one of them, and extends forwardly therefrom so that merchandise contained in blister packs 47 may be suspended from the support hook 35 at a location which is forward of the angle iron support member 37.

In order to deploy the product identification and information tag of the present invention in conjunction with angle iron 37 and support hook 35, sheet 10 is first folded along the fold line 19 which separates the intermediate portion 13 from the mounting portion 17. Sheet 10 is then folded in an opposite sense about fold line 25 so that sections 21 and 23 are brought into contact with one another. Slit 30 is then separated and the sections 21 and 23 are forced downwardly over the support hook 35 in the space between angle iron segments 39 and 41 until the support hook passes entirely through slit 30 and into the holes or apertures 27 and 29. This insertion procedure is best illustrated in FIG. 3. When the mounting portion 17 is properly forced onto the support hook 35, the rear section 21 may be released so that its natural resilience permits it to move to a position against the rear segment 41 of the angle iron support member. Forward section 23 of mounting portion 17 is placed against the forward segment 39 of the angle iron support member so that each section of the mounting portion is disposed adjacent the interior surface of a respective segment of the angle iron unit 37. In this position of the mounting portion 17, the intermediate portion 13 of the display tag projects forwardly above support hook 35 so that the turned up forward end of the support hook projects through slot 31. The distal end of the sheet 10 is then folded at the forward fold line 15 in order to dispose the display section 11 downwardly and forwardly of the support hook.

The purpose of the slot 31 is to receive the distal end of support hook 35 and thereby provide lateral stability for intermediate section 13. This prevents the tag from flexing laterally and becoming positioned alongside the supported merchandise items 47 rather than above the support hook 35.

It is seen that the mounting portion sections or panels 21 and 23 of the tag are stably disposed within the angle iron member 37 and are secured to the support hook 35. The tag cannot be inadvertently removed from the support hook or from its location inside the angle iron member 37. The tag can be intentionally removed from its mounting, however, by spreading slit 30 and pulling up on the mounting portion so that the support hook can be passed through the slit and disengaged from the sheet 10.

The display section 11 of the sheet 10 is arranged to receive the product identification and/or information, either in the form of a label which adheres to display portion 11 or by other suitable means.

In the first embodiment tag thus far described, the mounting portion 17 consists only of the two panels 21, 23 which extend directly from the back end (defined by bend line 19) of intermediate portion 13 of tag. FIGS. 6–11 of the drawings show a second embodiment tag having a four-panel mounting portion which is formed into a wedge for use, as will be described, and which, inter alia, provides particularly good lateral stability to the tag when mounted on a support hook and angle iron support assembly.

The second embodiment tag is again formed from an elongate plastic sheet 50 (FIG. 6) provided longitudinally with an intermediate portion 52 (conforming generally in length to intermediate portion 13 of tag 10 for use with a similar length support hook) and a mounting portion 54. In this embodiment as illustrated, there is no display portion at the distal end 56 of the intermediate portion equivalent to display portion 11 of the first embodiment. Rather, sheet 50 in the illustrated form, is provided with a lateral slit 58 adjacent the distal end for receipt of a separate display element (not shown) as fully described in Applicant's co-pending patent application Ser. No. 719,116, filed Apr. 12, 1985 for "Improvements Relating To Product Identification Tags," and the contents of which is expressly incorporated herein by reference. It will be understood, however, that the second embodiment tag may, alternatively, be provided with an integral display portion as in the first embodiment.

Adjacent transverse slit 58, intermediate portion 52 is provided with a slot 60 equivalent to slot 31 of the first embodiment, for receiving the distal end of a support hook as previously described.

Mounting portion 54 of tag 50 is defined by four distinct panels 62, 64, 66, 68 separated by transverse bend lines 70, 72, 74. Panel 62 extends from the back end of intermediate portion 52, its junction with the intermediate portion being defined by an imaginary transverse line 76. When suitably folded about bend lines 70, 72, 74 either upwardly or downwardly with respect to intermediate portion 52 about line 70 (See FIG. 7) the four panels of the mounting portion can be formed into a triangular-section wedge, with panel 68 underlying (or overlying) panel 62, panels 64, 66 forming an angle therebetween conforming to the angle between the arms 39', 41' of an angle iron support member 37' and with bend line 74 in register with imaginary line 76. (The geometry of the panels can readily be determined in order to make the angle between panels 64, 66 conform to the angle between arms 39', 41'.) Panels 62, 68 are, moreover, provided with press-down edge tabs 78 which are mutually aligned when the mounting portion is folded as aforesaid in either direction, so that the tabs can be folded down in unison, See FIGS. 8 and 9, to retain the mounting portion in stabilized wedge-shaped form.

Panels 64, 66 are provided with respective apertures 80, 82 on the longitudinal center line of the tab conforming generally with apertures 27, 29 of the first embodiment, and an elongate slot 84 connecting the apertures and extending across bend line 72 also along the longitudinal center line of the tab. Slot 84 may, in the second embodiment, be wider than equivalent slit 30 of the first embodiment, and it may diverge from the respective apertures 80, 82 toward bend line 72. As in the previous embodiment, aperture 80 may be more closely spaced to bend line 72 than aperture 82. The configuration of apertures 80, 82 and slot 84 is such that when the mounting portion is formed into a wedge, as described above, it may be pressed down into support member 41' with slot 84 engaging over the back end of support hook 35' which, as previously, is supported in aperture 43' and notch 45' of the support member, and with apertures 80, 82 snapping into engagement over the hook in juxtaposition to aperture 43' and notch 45'. It will further be noted that the panels 64, 66 are somewhat larger than the equivalent panels 21, 23 of the first embodiment (aperture 80 does not overlap bend line 70) so that the top of the tag including intermediate portion 52 is situated at a somewhat increased height above hook 35'.

Figure 9:
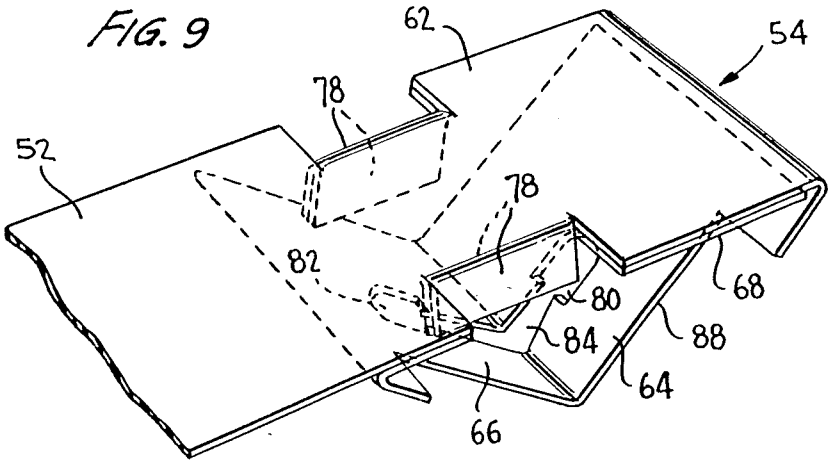
FIG. 9 is a view similar to FIG. 8 showing the mounting portion formed by folding in the opposite direction.
Figure 7:
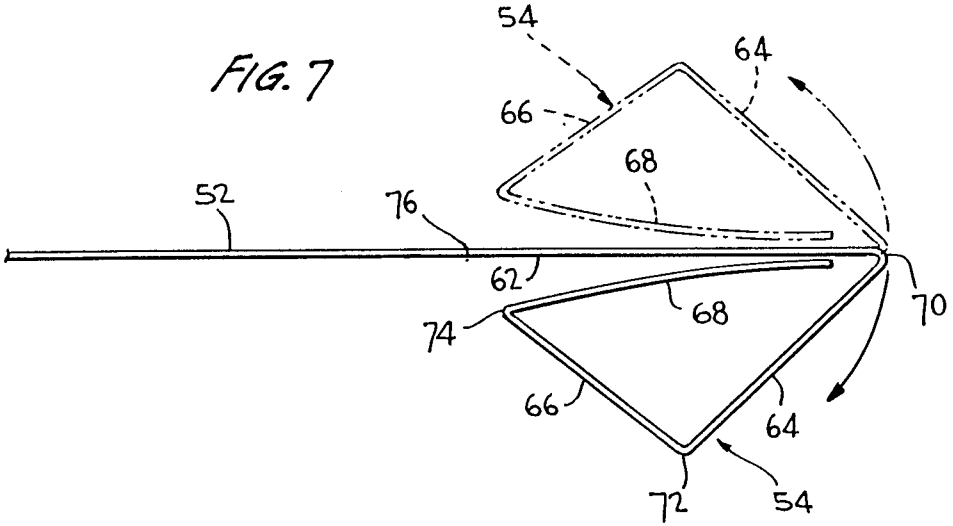
FIG. 7 is an elevation view of a rearward end of the second embodiment tag showing alternative ways of folding is mounting portion.
Figure 11:
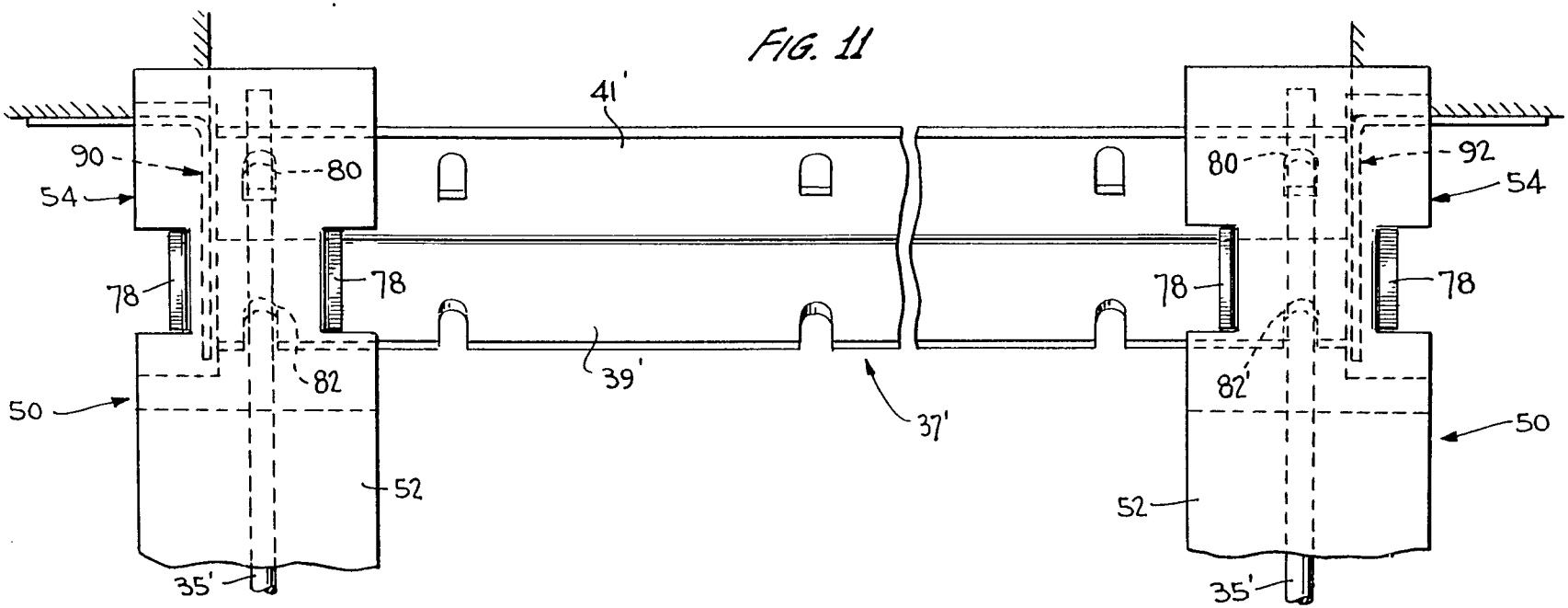
FIG. 11 is a plan view of the angle-iron support showing attachment brackets and support hooks with attached product identification and information tags at both ends thereof.

Reverting to FIG. 6, it will be seen that panels 62, 68 include on one side of the tag a push-out section 86 defined by perforated line 88. The purpose of section 86 (when removed) is to allow the tag to be fitted on a hook 35' which is positioned adjacent either end of the support member 37' close to one or other of a left hand or right hand angled support backet 90, or 92, attached to a wall or the like by a nut 94, for example. It will be understood that the tag need only be provided with a push-out section 86 on one side because of the facility of the mounting portion 54 to be folded to form a wedge either upwardly or downwardly (FIG. 7). Depending on the direction of bending, the push-out section 86 can provide clearance for the left hand bracket 90 (FIG. 8) or for the right hand bracket 92 (FIG. 9). FIG. 11 shows tags 50 used on hooks 35' closely adjacent both the left and right hand brackets. When the tag is used on a hook closer to the center of support member 37', the push-out section can be left in place.

From the foregoing it will be appreciated that the invention makes available novel product identification and information display tags which can be mounted on a support hooks of the type supported by an angle iron type of support member. The resulting tags permit product identification and information to be displayed forwardly of merchandise items suspended from the generally horizontal support hook.

Having described preferred embodiments of new and improved product identification and information tags constructed in accordance with the present invention, it is believed that other modifications, variations and changes will be suggested to those skilled in the art in light of the above disclosure. It is therefore to be understood that all such variations, modifications and changes are believed to fall within the scope of the present invention as defined in the appended claims.

I claim:

1. A product information and display tag for use in conjunction with an elongate product support hook carried in a V-shaped elongate support member having respective limbs opening upwardly, the hook projecting forwardly in perpendicular relation to the support member and being mounted in openings in the respective limbs, the tag comprising an elongate plastic sheet having at one end a mounting portion for insertion in the V-shaped support, and an elongate intermediate portion extending from the mounting portion for lengthwise projection over the hook to provide product information at a distal end thereof, the mounting portion including a pair of panels foldable about a transverse fold line to define an angle therebetween substantially conforming to the angle between said limbs, apertures in the respective panels located on a longitudinal center line of the tag, the apertures being connected by a cut extending along said center line across said fold line, the cut enabling the mounting portion to be pressed over a portion of the hook spanning said limbs to snap the apertures over said portion of the hook and situate the apertures in juxtaposition to said openings.

2. The invention as defined in claim 1 wherein one of said panels extends from a transverse bend line forming a junction with the intermediate portion of the tag, and the other of said panels terminates at a rearward end of the tag.

3. The invention as defined in claim 2 wherein the aperture in said one of the panels overlaps the bend line.

4. The invention as defined in claim 2 wherein the tag includes an integral fold-down display portion at the distal end of the intermediate portion.

5. The invention as defined in claim 2 wherein said cut comprises a slit of negligible thickness.

6. The invention as defined in claim 1 wherein the mounting portion consists of four panels including a first panel connected to said intermediate portion, said pair of panels, and a fourth panel, one of said pair of panels being connected to the first panel by a transverse bend line, the fourth panel being connected to the other of said pair of panels by another transverse bend line, said panels being adapted for folding about the fold line and bend lines to bring said fourth panel under said first panel and form a triangular-section wedge with said pair of panels forming inclined wedge limbs, and said fold line forming a wedge apex, and said apertures on opposite sides of the apex connected by said cut.

7. The invention as defined in claim 6 including bend-in tabs on the first and fourth panels respectively positioned for mutual registration when the panels are formed into the wedge and bending in unison to stabilize the wedge.

8. The invention as defined in claim 6 wherein said cut comprises a die-cut slot in the mounting portion which diverges from the respective apertures toward the transverse fold line.

9. The invention as defined in claim 6 wherein the mounting portion includes an elongate press-out section on one side extending from said transverse fold line along the respect pair of panels toward the respective bend lines, the press-out section when removed providing clearance for a support bracket at one end of the V-shaped support member when the tag is used on a hook located adjacent the bracket.

10. The invention as defined in claim 9 wherein the mounting portion can be folded selectively in opposite directions about the bend lines and fold line to present the press-out section selectively on opposite sides of the wedge.

11. An article of manufacture in the form of an elongated flexible plastic sheet including first and second ends and having display, intermediate, and mounting portions disposed at successive longitudinal locations along said sheet, said sheet having first and second longitudinally spaced and transversely extending fold lines impressed into said sheet, wherein said display portion includes said first end, wherein said mounting portion includes said second end and said second fold line and is separated from said intermediate portion by said first fold line, said mounting portion being subdivided into first and second adjacent panels by said second fold line, wherein said intermediate portion is substantially longer than each of said display and mounting portions, wherein said mounting portion has first and second die-cut apertures in the first and second panels respectively, said apertures being located on a longitudinal center line of the sheet, and wherein said mounting portion further includes a slit extending lengthwise along the center line across said second fold line from said first aperture to said second aperture.

12. The article as defined in claim 11 wherein the slit is of negligible thickness.

13. The article as defined in claim 11 wherein the apertures have centers which are unequally spaced from the second fold line.

14. The article as defined in claim 11 wherein the display portion is separated from the intermediate portion by a third transversely extending fold line impressed into the sheet.

15. An article of manufacture in the form of an elongated flexible plastic sheet including first and second ends, a first transverse fold line extending across the sheet in spaced relation from the second end to define a first panel therebetween, a second transverse fold line extending across the sheet in spaced relation from the first fold line to define a second panel therebetween, a third transverse fold line extending across the sheet in spaced relation from the second fold line to define a third panel therebetween, the sheet being foldable about said fold lines to form said panels into a triangular-section wedge with said first panel underlying a panel portion of the sheet adjacent said third panel, with said second and third panels defining downwardly inclined converging limbs of the wedge, and with said second transverse fold line forming an apex of the wedge, the sheet further including first and second apertures in the second and third panels respectively, both said apertures being centered on a longitudinal center line of the sheet, a longitudinal cut in the sheet extending along the center line connecting said apertures, and an elongate sheet portion extending from said panel portion to the first end of the sheet.

16. The article as defined in claim 15 wherein said longitudinal cut comprises a die-cut slot in the sheet which diverges from each of said apertures toward the second transverse fold line.

17. The article as defined in claim 16 wherein the second aperture is more closely spaced to the second transverse fold line than is the first aperture.

18. The article as defined in claim 16 wherein the sheet includes a transverse slit adjacent the first end for connection of a releasable display element.

19. The article as defined in claim 16 wherein the sheet includes press-down side tabs formed in the first panel and the panel portion of the sheet respectively, the tabs being positioned for mutual registration when said panels are folded into a wedge as aforesaid and for folding down in unison to stabilize the wedge.

20. The article as defined in claim 19 wherein said tabs are provided on both sides of the sheet.

21. The article as defined in claim 16 wherein the sheet includes an elongate rectangular press-out section on one side extending across said second fold line toward the first and third fold lines.

* * * * *